US007059290B2

(12) United States Patent
Ishikawa et al.

(10) Patent No.: US 7,059,290 B2
(45) Date of Patent: Jun. 13, 2006

(54) CYLINDER LINER WITH ITS INNER PERIPHERAL SURFACE FORMED WITH SURFACE TREATMENT LAYER, AND METHOD FOR MACHINING TO THE SURFACE TREATMENT LAYER

(75) Inventors: Yoshiki Ishikawa, Tochigi-ken (JP); Fujio Anzai, Tochigi-ken (JP)

(73) Assignee: Nippon Piston Ring Co., Ltd., Saitama-ken (JP)

( * ) Notice: Subject to any disclaimer, the term of this patent is extended or adjusted under 35 U.S.C. 154(b) by 239 days.

(21) Appl. No.: 10/394,141

(22) Filed: Mar. 24, 2003

(65) Prior Publication Data

US 2003/0192501 A1 Oct. 16, 2003

(30) Foreign Application Priority Data

Mar. 27, 2002 (JP) ..... P2002-088000

(51) Int. Cl.
*F02F 1/00* (2006.01)
*B24B 33/00* (2006.01)

(52) U.S. Cl. ..... 123/193.2

(58) Field of Classification Search ... 123/193.1–193.4; 148/523; 164/100; 428/517
See application file for complete search history.

(56) References Cited

U.S. PATENT DOCUMENTS 5,891,273 A * 4/1999 Ruckert et al. ..... 148/523
6,074,763 A * 6/2000 Rueckert et al. ..... 428/577
6,162,500 A 12/2000 Erbsloh et al.
6,220,214 B1 * 4/2001 Kojima et al. ..... 123/193.2
6,286,583 B1 * 9/2001 Rueckert et al. ..... 164/100
6,354,259 B1 * 3/2002 Fischer et al. ..... 123/193.2

FOREIGN PATENT DOCUMENTS

| | | |
|---|---|---|
| DE | DIN4776 | 5/1990 |
| EP | 0 693 618 A1 | 1/1996 |
| JP | 60-237145 | 11/1985 |
| JP | 61-157875 | 7/1986 |
| JP | 08-02197 | 1/1996 |
| WO | WO 01/33065 A1 | 5/2001 |

* cited by examiner

*Primary Examiner*—Marguerite McMahon
(74) *Attorney, Agent, or Firm*—Sughrue Mion, PLLC

(57) ABSTRACT

A cylinder liner for use in an internal combustion engine has an inner peripheral surface at which a surface treatment layer is formed upon water vapor treatment. The surface treatment layer has a surface configuration capable of providing excellent lubrication oil retaining function and initial break-in property as well as capable of being machined easily. The treatment surface of the cylinder liner has a plateau configuration providing a surface roughness Rz of 0.8 to 5.9 μm, and the plateau configuration is defined under DIN4776 by a reduced peak height Rpk of not more than 0.64 μm, a core roughness depth Rk of 0.05 to 1.8 μm, and a reduced valley depth Rvk of 0.15 to 3.3 μm. For grinding to the surface, a honing machine employs a grindstone containing metal bonded diamond grains at high density. Diamond grain size is not less than 4000.

3 Claims, 4 Drawing Sheets

Rpk
Rk
Rvk
3
SPECIFIC ROUGHNESS CURVE
g
a
c
e
40 %
f
5
4
d
t
h
0
20
40
60
80
100 %
tp
GRINDING LEVEL (μm)
BEARING AREA CURVE 4
& MINIMUM INCLINATION LINE

CYLINDER LINER WITH ITS INNER PERIPHERAL SURFACE FORMED WITH SURFACE TREATMENT LAYER, AND METHOD FOR MACHINING TO THE SURFACE TREATMENT LAYER

BACKGROUND OF THE INVENTION

The present invention relates to a cylinder liner having an inner peripheral surface provided with a surface treatment layer by a water vapor treatment, etc, and a method for processing the cylinder liner for use in an internal combustion engine.

In a cylinder liner for a conventional Diesel engine, phosphate treatment or nitriding treatment is performed to form a surface treatment layer on an inner peripheral surface of the liner in order to improve wear resistance. Then a honing is performed on the surface treatment layer on the inner peripheral surface of the cylinder liner for final machining to the inner surface. In the conventional final grinding to the inner peripheral surface, a resinoid bonded grindstone containing silicon carbide is used. The grain size of the silicon carbide is not more than 3000, and the silicon carbide is contained in an amount less than 50% in the resultant grindstone. As a result, the surface treatment layer has a cross-hatching pattern providing oil pockets which are advantageous for a lubricating property.

Recently, the diesel engine is subjected to a severe working condition due to a severe requirements in exhaust gas. Therefore, corrosion resistance as well as wear resistance are required in the cylinder liner. In order to meet with the demand, a cylinder liner having a surface treatment layer provided by a water vapor treatment is described in WO 01/33065A1.

The water vapor treatment forms a surface treated layer mainly formed of triiron tetroxide ($Fe_3O_4$) which provides sufficient wear resistance and corrosion resistance. However, because triiron tetroxide is extremely brittle and has high hardness, finishing or final machining to the inner peripheral surface of the cylinder liner subjected to water vapor treatment is extremely difficult in comparison with the machining to the inner peripheral surface of a cylinder liner formed with the conventional phosphate layer or the conventional nitriding treatment layer. Further, the difficulty in machining is increased in proportion to the increase in thickness of the water vapor treatment layer.

If the inner peripheral surface of the cylinder liner subjected to the water vapor treatment is machined by a honing machine using a conventional grinding wheel, excessive wearing of the grinding wheel occurs, and such honing requires a prolonged time period. If hardness of the silicon carbide is increased and grain size thereof is reduced in an attempt to provide a cross-hatching pattern on the inner peripheral surface of the cylinder liner, the inner surface is injured due to thrusting of the cutting chips into the inner surface.

Further, in the conventional technique, no attention is drawn to an initial break-in property of the cylinder liner, but attention is only drawn to an oil retaining property on the inner peripheral surface of the cylinder liner.

SUMMARY OF THE INVENTION

The present invention is attained to overcome the above described problems, and it is an object of the present invention to provide a cylinder liner, whose inner peripheral surface is formed with a surface treatment layer such as a water vapor treatment layer, for use in an internal combustion engine, the treatment layer having a surface configuration capable of providing oil pockets effective for lubricating function, superior initial break-in property, and sufficient sliding characteristic in a normal operating condition.

Another object of the present invention is to provide a method for machining to a surface treatment layer on an inner peripheral surface of the cylinder liner for use in an internal combustion engine, the surface treatment layer being formed by water vapor treatment etc., the machining method being capable of providing effective lubrication oil retaining function and sufficient initial break-in property on the machined surface and being capable of prolonging a service life of a grindstone used for the machining, and capable of reducing a machining period in comparison with the conventional machining method.

These and other objects of the present invention will be attained by a cylinder liner having an inner peripheral surface formed with a surface treatment layer, a surface of the surface treatment layer being plateau configuration providing a surface roughness Rz of 0.8 to 5.9 μm, and the plateau configuration being defined under DIN4776 by a reduced peak height Rpk of not more than 0.64 μm, a core roughness depth Rk of 0.05 to 1.8 μm, and a reduced valley depth Rvk of 0.15 to 3.3 μm.

In another aspect of the invention, there is provided a method for machining to an inner peripheral surface of a cylinder liner, the inner peripheral surface being formed with a surface treatment layer, the method including the step of grinding a surface of the surface treatment layer by a honing machine employing a grindstone in which diamond grains whose grain size is not less than 4000 are contained with a metal bond, so that the surface of the surface treatment layer is machined into plateau configuration providing a surface roughness Rz of 0.8 to 5.9 μm, and the plateau configuration being defined under DIN4776 by a reduced peak height Rpk of not more than 0.64 μm, a core roughness depth Rk of 0.05 to 1.8 μm, and a reduced valley depth Rvk of 0.15 to 3.3 μm.

A grind wheel containing the diamond grains can easily cut off each peak of the high hardness triiron tetroxide formed by the water vapor treatment so as to provide a plateau configuration at the surface of the treatment layer. The diamond grains are dense and fine, and therefore, the high hardness and brittle triiron tetroxide layer can be subjected to grinding without any destruction. Accordingly, any injury of the inner peripheral surface of the cylinder due to thrusting of the cutting chips into the surface can be obviated. Further, because the diamond grains are bonded together by metal bond to form the grindstone, minute diamond grains are flowed together with the cutting chips during grinding operation. Consequently, new grinding surface appears on the grindstone for promoting the grinding performance.

Speaking to the conventional cylinder liner in which a surface treatment layer is formed on its inner peripheral surface and the surface is subjected to honing so as to provide a cross-hatching pattern considered to be effective for the lubrication oil retaining function, the honing or grinding is extremely difficult to achieve in case the high hardness and brittle iron oxide layer formed upon water vapor treatment is formed as the surface treatment layer. On the other hand, according to the cylinder liner of the present invention in which the surface treatment layer at the inner peripheral surface of the cylinder liner has a plateau configuration providing a surface roughness Rz of 0.8 to 5.9 μm, and the plateau configuration being defined under DIN4776 by a reduced peak height Rpk of not more than 0.64 μm, a core roughness depth Rk of 0.05 to 1.8 μm, and a reduced valley depth Rvk of 0.15 to 3.3 μm. Therefore, the cylinder liner can provide excellent sliding characteristic, desirable initial break-in property, and less attaching to the associated piston ring. Further, grinding work is relatively performed easily in accordance with the above-described ranges even if the surface treatment layer is formed from the high hardness and brittle material such as iron oxide formed upon water vapor treatment.

Further, according to the conventional machining to the inner peripheral surface of the cylinder liner having the surface treatment layer, because the resinoid bonded grindstone containing less than 50% of silicon carbide whose grain size is not more than 3000 is used for grinding, extensive machining period is required and reduced service life of the grindstone results if the surface treatment layer is made from the high hardness and brittle iron oxide. On the other hand, according to the method for machining to the surface treatment layer formed on the inner peripheral surface of the cylinder liner, because used is the grindstone in which metal bonded diamond grains whose grain size is not less than 4000 are contained at high density, reduced machining period can result prolonging the service life of the grindstone even if the surface treatment layer is formed from the high hardness and brittle material such as iron oxide formed upon water vapor treatment.

BRIEF DESCRIPTION OF THE DRAWINGS

In the drawings;

FIG. 2(*b*) is a bearing area curve of the inner peripheral surface of the cylinder liner according to the embodiment;

FIGS. 3(*a*) through 3(*e*) show a process for obtaining the specific roughness profile and in which;

FIG. 3(*a*) shows a profile curve 6 and a mean line 7 of a phase correct filter waviness profile;

FIG. 3(*b*) shows a valley removing profile curve 8;

FIG. 3(*c*) shows a reference mean line 9;

FIG. 3(*d*) shows subtraction of the reference mean line 9 from the profile curve 6;

FIG. 3(*e*) shows a resultant specific profile curve 10;

FIG. 4(*b*) shows a roughness profile of a surface treatment layer after conventional grinding; and FIG. 4(*c*) shows a roughness profile of a surface treatment layer after grinding in accordance with the present embodiment.

DETAILED DESCRIPTION OF THE PREFERRED EMBODIMENT

Figure 1:
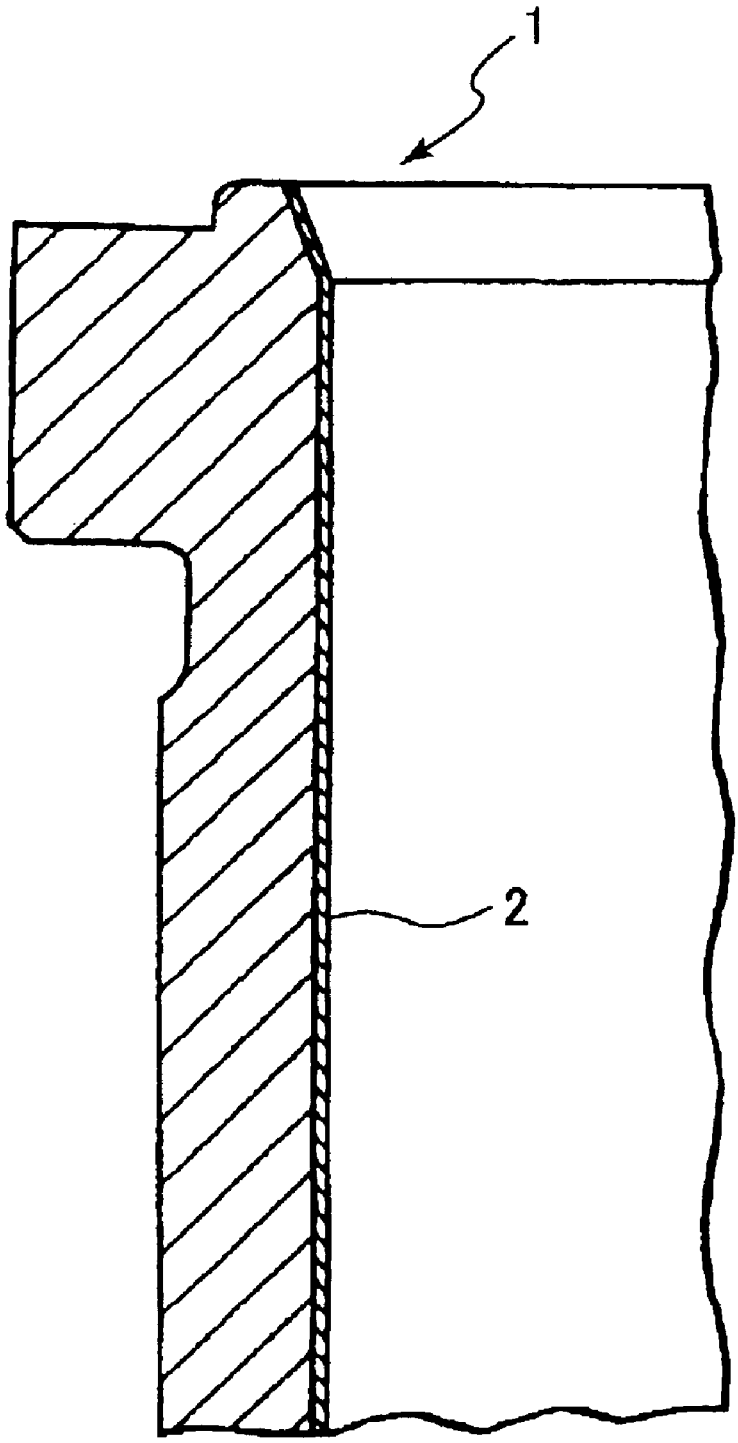
FIG. 1 is a cross-sectional elevation showing a cylinder liner according to one embodiment of the present invention.

A cylinder liner and a method for machining to the inner peripheral surface of the cylinder liner according to one embodiment of the present invention will be described with reference to the drawings. As shown in FIG. 1, a cylinder liner 1 has an inner peripheral surface formed with a water vapor treatment layer 2. The cylinder liner 1 is made from a cast iron containing 3.15 mass % of C, 2.0 mass % of Si, 0.75 mass % of Mn, 0.35 mass % of P, 0.06 mass % of S, 0.4 mass % of Cu, 0.3 mass % of Mo, 0.09 mass % of B, and the balance Fe.

A thickness of the water vapor treatment layer at the inner peripheral surface of the cylinder liner ranges from 10 to 30 μm. After machining to an outer peripheral surface of the cylinder liner 1, the inner peripheral surface of the cylinder liner is subjected to grinding by a honing machine which employs a grindstone containing diamond grains. The diamond grain has a grain size of 5000, an average grain diameter of 2.5 μm, grain diameter distribution ranging from 1.5 to 4.0 μm. These diamond grains are congregated together with binding agent (metal bond) of MH5 at a binding degree K. As a result of grinding, the inner peripheral surface is finished into plateau configuration providing a surface roughness Rz of 0.8 to 5.9 μm, and providing a reduced peak height Rpk of not more than 0.64 μm, a core roughness depth Rk of 0.05 to 1.8 μm, and a reduced valley depth Rvk of 0.15 to 3.3 μm, those Rpk, Rk and Rvk are defined in DIN4776.

The iron oxide film formed upon water vapor treatment provides a coarse surface in which acute peaks protrude from the surface. However, in the illustrated embodiment, the reduced peak height Rpk is set not more than 0.64 μm in order to remove large peaks without destroying the iron oxide film to form the surface into plateau configuration. As a result, surface roughness Rz of 0.8 to 5.9 μm can be obtained which can avoid generation of thermal seizure as a result of sliding contact with a piston ring. Accordingly, sufficient lubrication oil retaining property at the time of initial break-in period can result thereby providing excellent initial break-in property.

Further, the illustrated embodiment does not form a cross-hatching pattern serving as lubrication oil pockets at the inner peripheral surface of the cylinder liner. However, because the core roughness depth Rk of 0.05 to 1.8 μm and the reduced valley depth Rvk of 0.15 to 3.3 μm are provided at the surface of the iron oxide layer to provide oil pockets at the profile valleys, sufficient lubrication oil retaining property can be exhibited during normal operating phase of the internal combustion engine after the initial break-in, and thermal seizure can be prevented, and the inner peripheral surface of the cylinder liner is in sliding relationship with the piston ring at a low friction.

The grindstone containing diamond grains having grain size of 5000, binding degree of K and congregated together with the metal bond MH5 is used to gradually perform grinding to the inner peripheral surface of the cylinder liner while increasing a reciprocation speed of the honing machine, the relatively brittle and high hardness iron oxide layer 2 formed at the inner peripheral surface by the water vapor treatment can undergo grinding within a relatively short period without destruction of the iron oxide layer. Further, this grindstone exhibits less wearing or consumption amount than that of the above-described conventional resinoid bonded grindstone, thereby prolonging a service life of the grindstone.

Resultant service life of the grindstone and the grinding period are identified as an index of 1, in case of the grinding to the water vapor treatment layer having a thickness of 10 μm and formed on the inner peripheral surface of the cylinder liner so as to provide a conventional cross-hatching pattern serving as oil pockets by employing the conventional resinoid bonded grindstone containing less than 50% of silicon carbide whose grain size is not more than 3000. In comparison with the index "1", the service life of the grindstone in accordance with the present embodiment provides an index of 150, and grinding period index provides 0.31. In other words, the grindstone according to the present embodiment provides its service life 150 times as high as that of the conventional grindstone, and provides a grinding period reduced by 69%.

Figure 4A:
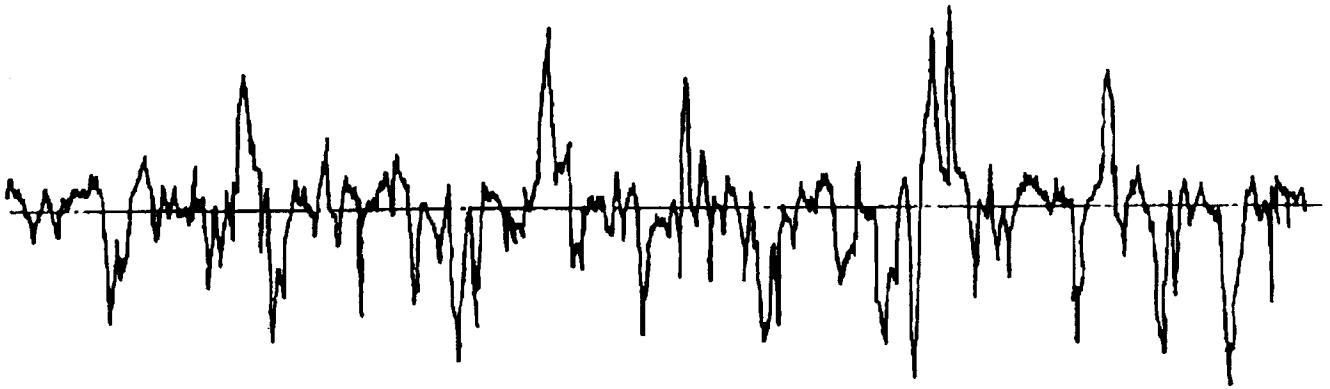
FIG. 4(*a*) through 4(*c*) show roughness profile of the cylinder liner and in which FIG. 4(*a*) shows a roughness profile of a surface treatment layer formed upon water vapor treatment prior to grinding.
Figure 4B:
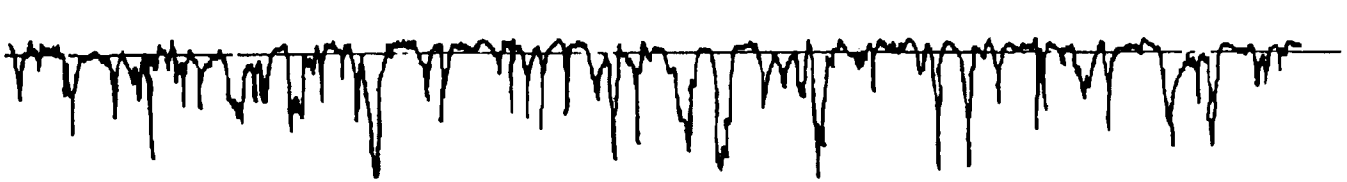
Figure 4C:
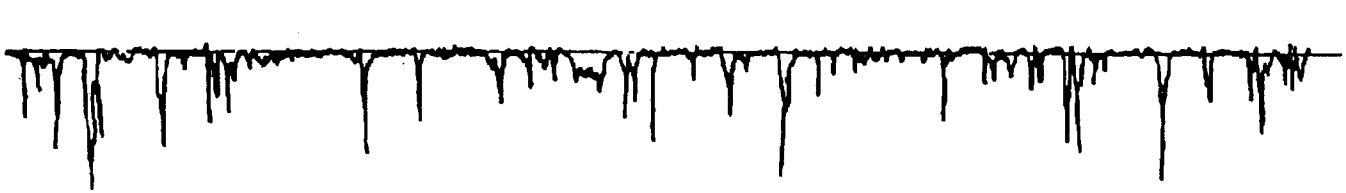

FIG. 4(*a*) is a surface roughness profile of a cylinder liner subjected to water vapor treatment and prior to grinding. FIG. 4(*b*) is a surface roughness profile of a cylinder liner subjected to water vapor treatment and after the conventional grinding. In the conventional grinding, used is a resinoid bonded grindstone containing silicon carbide. The grain size of the silicon carbide is not more than 3000, and the silicon carbide is contained in an amount less than 50% in the resultant grindstone. FIG. 4(*c*) is a surface roughness profile of a cylinder liner subjected to water vapor treatment and after grinding in accordance with the present embodiment. As shown in FIG. 4(*a*), the surface of the cylinder liner subjected to the water vapor treatment prior to grinding provides acute peaks protruding toward an axis of the cylinder liner. On the other hand, in the surface roughness profile shown in FIG. 4(*b*), acute peaks disappear improving the surface configuration in comparison with the profile of FIG. 4(*a*). However, the surface still provides large volume of concave and convex portions. In contrast, according to the present embodiment as shown in FIG. 4(*c*), the surface has plateau configuration, and no substantial peaks can be found at the surface.

Figures 2A, 2B:
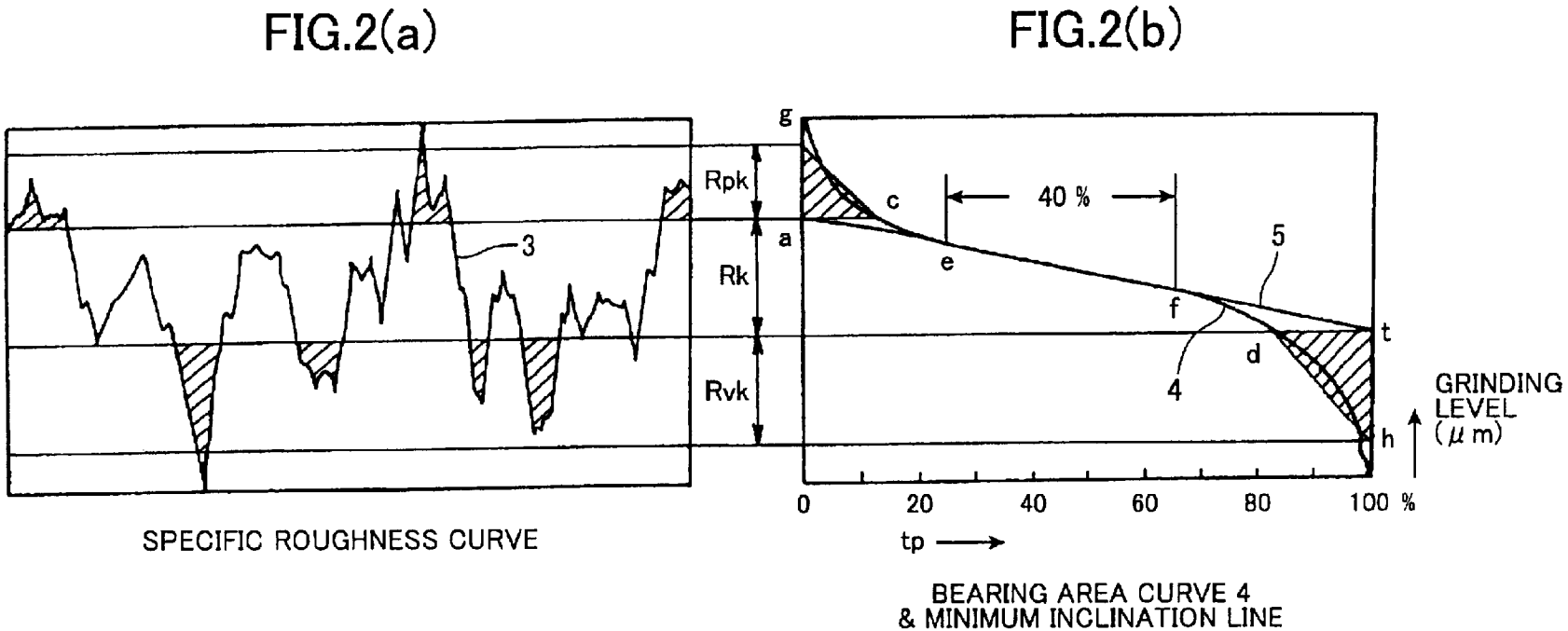
FIG. 2(*a*) is a specific roughness profile of an inner peripheral surface of the cylinder liner according to the embodiment.
Figure 3A:
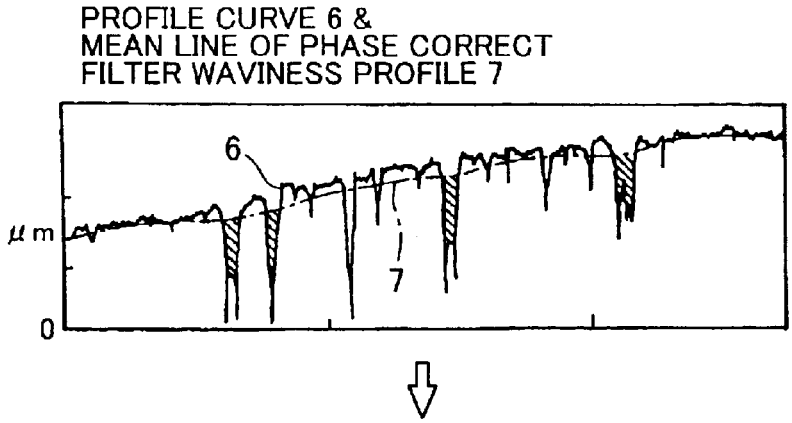
Figure 3B:
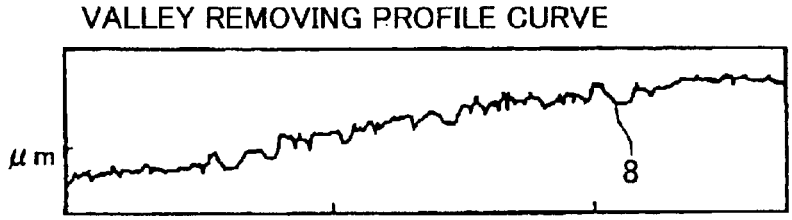
Figure 3C:
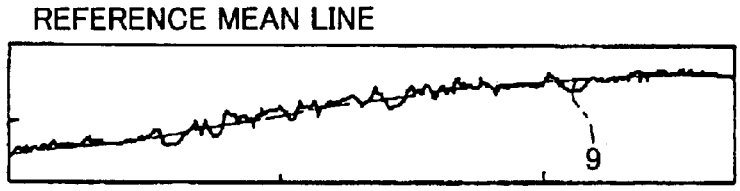
Figure 3D:
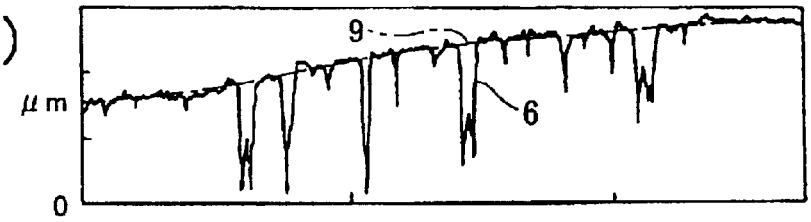
Figure 3E:
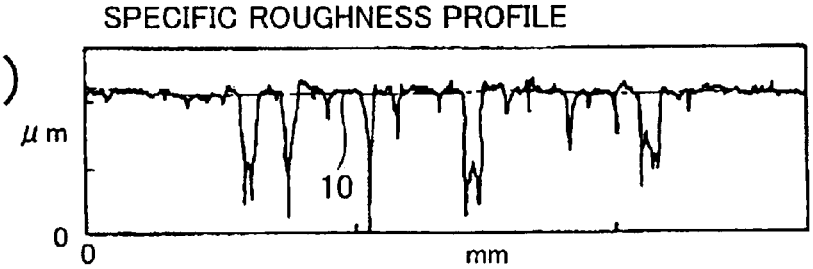

Reduced peak height Rpk, core roughness depth Rk and reduced valley depth Rvk are parameters defined in DIN4776 for mainly evaluating lubrication property of the plateau honing surface. These values can be obtained as shown in FIGS. 2(*a*) and 2(*b*). More specifically, a bearing area curve 4 shown in FIG. 2(*b*) is obtained based on a specific roughness profile 3 shown in FIG. 2(*a*). Then, a "40% width" extending in a direction of a relative material portion tp is selected on the bearing area curve 4. Minimum difference in height between a starting point of the 40% width and an end point of the 40% width, for example, point e and point f on the bearing area curve 4 are selected. Then, a minimum average slope line 5 passing through the points e and f is delineated. Then, obtained are a point "a" defined by an intersection of the minimum average slope line 5 and the 0% critical line(tp=0) and a point "b" defined by an intersection of the minimum average slope line 5 and the 100% critical line (tp=100). Then, obtained are a point "c" defined by an intersection of the bearing area curve 4 and a horizontal line passing through the point "a", and a point "d" defined by an intersection of the bearing area curve 4 and a horizontal line passing through the point "b".

Then, a point g is plotted on the 0% critical line (tp=0) so as to provide a right angled triangle acg whose area is equal to an area surrounded by the 0% critical line (tp=0) a line ac, and the bearing area curve 4. Further, a point h is plotted on the 100% critical line (tp=100) so as to provide another right-angled triangle dbh whose area is equal to an area surrounded by the 100% critical line (tp=100) a line db, and the bearing area curve 4. Thus, a vertical distance ag (i.e., a height of the right angled triangle acg corresponds to the reduced peak height Rpk. A vertical distance cd corresponds to the core roughness depth Rk which is indicative of a wearing height available for normal wearing range until the wear bearing surface cannot be used any longer after the termination of the initial break-in. A vertical distance bh i.e., a height of the right angled triangle dbh corresponds to the reduced valley depth Rvk.

A specific roughness profile can be obtained through the following procedure. First, a profile curve 6 shown in FIG. 3(*a*) is obtained based on DIN or JIS standard. Then, a mean line 7 of a phase correct filter waviness profile is obtained using a Gaussian phase correct filter based on the profile curve 6. Then, as shown in FIG. 3(*b*), a valley removing profile curve 8 is obtained in which profile valleys below the mean line 7 is removed from the profile curve 6. The valley removing profile curve 8 is then applied to the Gaussian phase correct filter to obtain a reference mean line 9 shown in FIG. 3(*c*). Then, the reference mean line 9 is subtracted from the profile curve 6 as shown in FIG. 3(*d*) to obtain a specific profile curve 10 shown in FIG. 3(*e*).

A target value and a range of the surface roughness Rz, reduced peak height Rpk, core roughness depth Rk, and reduced valley depth Rvk with respect to the inner peripheral surface of the cylinder liner are preferably adjusted depending on a thickness of the surface treatment layer as shown in Table 1 below.

TABLE 1

| Thickness(μm) | | 10 | 20 | 30 |
|---|---|---|---|---|
| Rz | Target value | 2 | 2 | 3.6 |
| | Range | 0.8–3.0 | 0.8–4.2 | 1.9–5.9 |
| Rpk | Target value | 0.025 | 0.2 | 0.25 |
| | Range | <0.05 | <0.6 | <0.64 |
| Rk | Target value | 0.2 | 0.3 | 0.84 |
| | Range | 0.1–0.53 | 0.05–0.52 | 0.2–1.8 |
| Rvk | Target value | 1.3 | 1.3 | 2.5 |
| | Range | 0.3–2.2 | 0.15–2.5 | 1.6–3.3 |

EXAMPLES

Wear test was performed with respect to cylinder liners according to the present embodiment, comparative example, and a conventional example. Each cylinder liner was installed in a diesel engine having a displacement of 1500 cc at rotation speed of 2100 r.p.m.

A piston ring which is an opponent sliding member had a base body made from martensitic stainless steel with an outer peripheral surface formed with a high hardness layer of Cr—N alloy provided by ion plating method. The high hardness layer provided a hardness of 1800 (mHv), and was grounded by an abrasive paper to provide a surface roughness Rz of 0.8 μm.

Each thickness, surface roughness Rz, reduced peak height Rpk, core roughness depth Rk, and reduced valley depth Rvk of the surface treatment layer in the present examples according to the present embodiment, comparative examples, and the conventional example are shown in Table 2 below. The comparative examples were such that at least one of Rz, Rpk, Rk, Rvk values is outside of the ranges of the present embodiment. The conventional example was provided by the conventional resinoid bonded grindstone containing less than 50% of silicon carbide having grain size not more than 3000. In Table 2, unit is μm.

TABLE 2

| | thickness | Rz | Rpk | Rk | Rvk |
|---|---|---|---|---|---|
| Example 1 | 10 | 1.5 | 0.025 | 0.2 | 1.3 |
| Example 2 | 20 | 2.0 | 0.2 | 0.3 | 1.3 |

TABLE 2-continued

| | thickness | Rz | Rpk | Rk | Rvk |
|---|---|---|---|---|---|
| Example 3 | 30 | 3.6 | 0.25 | 0.84 | 2.5 |
| Example 4 | 10 | 0.8 | 0.02 | 0.18 | 0.4 |
| Example 5 | 10 | 0.9 | 0.01 | 0.27 | 0.55 |
| Example 6 | 10 | 1.0 | 0.03 | 0.1 | 0.78 |
| Example 7 | 10 | 0.82 | 0.13 | 0.27 | 0.3 |
| Example 8 | 30 | 5.9 | 0.45 | 1.5 | 2.9 |
| Example 9 | 30 | 5.0 | 0.64 | 1.7 | 2.4 |
| Example 10 | 30 | 5.8 | 0.48 | 1.8 | 2.6 |
| Example 11 | 30 | 5.0 | 0.32 | 1.1 | 3.3 |
| Comparative 1 | 30 | 6.1 | 0.45 | 1.5 | 3.3 |
| Comparative 2 | 30 | 5.9 | 0.65 | 1.8 | 2.5 |
| Comparative 3 | 30 | 5.9 | 0.45 | 2.0 | 2.5 |
| Comparative 4 | 30 | 6.0 | 0.35 | 1.2 | 3.5 |
| Comparative 5 | 10 | 0.7 | 0.02 | 0.17 | 0.4 |
| Comparative 6 | 10 | 0.65 | 0.03 | 0.09 | 0.45 |
| Comparative 7 | 10 | 0.68 | 0.04 | 0.25 | 0.28 |
| Conventional | 10 | 4.0 | 0.7 | 1.6 | 2.7 |

Wear amounts of each cylinder liner example and associated piston ring were measured, the result of which is shown in Table 3 below. In Table 3, wear amount is represented as index in which wear amount of the conventional cylinder liner and the associated piston is represented as an index 1.

TABLE 3

| | Wear amount of Piston ring | Wear amount of Cylinder liner | Thermal Seizure |
|---|---|---|---|
| Example 1 | 0.61 | 0.9 | No |
| Example 2 | 0.65 | 0.9 | No |
| Example 3 | 0.75 | 0.9 | No |
| Example 4 | 0.65 | 0.9 | No |
| Example 5 | 0.7 | 0.9 | No |
| Example 6 | 0.82 | 0.9 | No |
| Example 7 | 0.8 | 0.9 | No |
| Example 8 | 0.92 | 0.95 | No |
| Example 9 | 0.95 | 0.97 | No |
| Example 10 | 0.98 | 0.98 | No |
| Example 11 | 0.9 | 0.95 | No |
| Comparative 1 | 1.05 | 1.05 | No |
| Comparative 2 | 1.03 | 1.03 | No |
| Comparative 3 | 1.05 | 1.05 | No |
| Comparative 4 | 1.01 | 1.03 | No |
| Comparative 5 | 1.1 | 1.05 | Yes |
| Comparative 6 | 1.12 | 1.05 | Yes |
| Comparative 7 | 1.05 | 1.05 | Yes |
| Conventional | 1.0 | 1.0 | No |

As is apparent from Table 3, cylinder liners according to the present examples 1 through 11 provided reduced wear amounts and associated piston rings also provided reduced wear amounts in comparison with those of the conventional example and its associated piston ring. Further, the cylinder liners according to the comparative examples provided the wear amounts greater than that of the conventional example, and associated piston ring also provided the wear amounts greater than that of the piston ring associated with the conventional example. Moreover, as is apparent from comparative examples 5 through 7, the cylinder liners having Rz values less than Rz ranges of the present embodiment provided thermal seizure.

While the invention has been described in detail and with reference to the specific embodiment thereof, it would be apparent to those skilled in the art that various changes and modifications may be made therein without departing from the spirit and scope of the invention. For example, the present invention can be applied to the cylinder liner whose inner peripheral surface is subjected to nitriding treatment.

What is claimed is:

1. A cylinder liner having an inner peripheral surface formed with a surface treatment layer, comprising:

a surface of the surface treatment layer having a plateau configuration with a surface roughness Rz of 0.8 to 5.9 μm, wherein the plateau configuration is defined under DIN4776 by a reduced peak height Rpk of not more than 0.64 μm, a core roughness depth Rk of 0.05 to 1.8 μm, and a reduced valley depth Rvk of 0.15 to 3.3 μm, wherein the surface treatment layer is a triiron tetroxide film.

2. A cylinder liner having an inner peripheral surface formed with a surface treatment layer, comprising:

a surface of the surface treatment layer having a plateau configuration with a surface roughness Rz of 0.8 to 5.9 μm, wherein the plateau configuration is defined under DIN4776 by a reduced peak height Rpk of not more than 0.64 μm, a core roughness depth Rk of 0.05 to 1.8 μm, and a reduced valley depth Rvk of 0.15 to 3.3 μm, wherein the surface treatment layer is formed by water vapor treatment.

3. A method for machining to an inner peripheral surface of a cylinder liner, the inner peripheral surface being formed with a surface treatment layer, comprising:

grinding a surface of the surface treatment layer by a honing machine employing a grindstone in which diamond grains whose grain size is not less than 4000 are contained with a metal bond, so that the surface of the surface treatment layer is machined into a plateau configuration that has a surface roughness Rz of 0.8 to 5.9 μm, wherein the plateau configuration is defined under DIN4776 by a reduced peak height Rpk of not more than 0.64 μm, a core roughness depth Rk of 0.05 to 1.8 μm, and a reduced valley depth Rvk of 0.15 to 3.3 μm, wherein the surface treatment layer is formed by water vapor treatment.

* * * * *